United States Patent [19]

Aguirre et al.

[11] Patent Number: 4,739,990

[45] Date of Patent: Apr. 26, 1988

[54] SELF-DEFENSE/ATTACK DEVICE

[76] Inventors: Julio A. Aguirre, Rte. 5, Box 353, Santa Fe, N. Mex. 87501; Armand G. Winfield, P.O. Box 1296, Santa Fe, N. Mex. 87504-1296; John G. Dennett, Jr., 4041 Alta Monte NE., Albuquerque, N. Mex. 87110

[21] Appl. No.: 848,925

[22] Filed: Apr. 7, 1986

[51] Int. Cl.[4] ..... F41B 15/02; F41B 15/04

[52] U.S. Cl. ..... 273/84 R; 273/84 ES

[58] Field of Search ..... 273/84 R, 84 ES, 67; D21/145; D22/117

[56] References Cited

U.S. PATENT DOCUMENTS

| | | | |
|---|---|---|---|
| D. 230,150 | 1/1974 | Anderson | 273/84 R X |
| 791,376 | 5/1905 | Somes | 273/84 R |
| 1,018,358 | 2/1912 | Litsey | 273/84 R X |
| 1,083,041 | 12/1913 | Worgan et al. | D21/145 X |
| 1,130,355 | 3/1915 | Von Eschen | 273/84 R |
| 3,432,077 | 3/1969 | Voll | 273/84 R |
| 4,052,063 | 10/1977 | Wong | 273/84 R |
| 4,109,912 | 8/1978 | Zentmyer | 273/84 R |
| 4,132,409 | 1/1979 | Taylor | 273/84 R |
| 4,203,599 | 5/1980 | Starrett | 273/84 R |
| 4,479,171 | 10/1984 | Mains | 273/84 R |
| 4,522,398 | 6/1985 | Swartz et al. | 273/84 R |
| 4,667,958 | 5/1987 | Raitto | 273/84 R |

*Primary Examiner*—Randolph A. Reese
*Assistant Examiner*—John Ricci
*Attorney, Agent, or Firm*—Kendrick, Netter & Bennett

[57] ABSTRACT

A self-defense/attack device comprises a rigid, tubular body having a blunt tip at one end that is adapted to deliver lethal/non-lethal blows to the chest or other regions of a human body. Joined to the tubular body at a substantially right angle to the longitudinal axis of the body and closer to the end opposite the blunt tip is a rigid projection shorter in length and smaller in circumference than the body itself. The projection terminates in a rounded blunt tip that can also deliver lethal/non-lethal blows to an attacker.

12 Claims, 6 Drawing Sheets

SELF-DEFENSE/ATTACK DEVICE

This invention relates to a self-defense/attack device that is highly versatile, and that can include one or a plurality of additional self-defense, law enforcement and other features. The device comprises a rigid, tubular, solid or hollow body having a blunt tip at one end or at both ends. The tubular body is of a size and shape adapted for gripping in one hand. Joined to the body at substantially a right angle to its longitudinal axis, and closer to the other end of the body than to the end having the blunt tip, are one or more rigid projections, each shorter in length and smaller in circumference than the body. Depending upon their size, shape and length, the blunt tips at one end (or both ends) of the tubular body can be adapted to deliver lethal or non-lethal blows to the chest or other regions of a human body. Where the blunt tip is not more than about two inches in length, and substantially rounded, the device is primarily useful in self-defense. Where the blunt tip is longer than about two inches, and tapers to a sharper point, the device is useful both for self-defense and for attack. The blunt tip can have an uneven or serrated end to facilitate formation of a telltale mark upon an assailant.

In preferred embodiments, the outer wall surfaces of the tubular body can have gripping means such as striations, projections, indentations or ribs mounted on at least a portion of the circumference of the body, or can be smooth. For example, these gripping means can comprise a plurality of ribs spaced substantially equidistant from one another around the circumference of the body with each of the ribs substantially parallel to the longitudinal axis of the body and to one another. As another example, the body and spur can have a plurality of indentations to receive the fingers of a user of the device. These ribs or indentations are preferably arrayed and configured to induce the user to align the spur on an axis with the user's hand, wrist and forearm. The ribs or indentations can be formed on sleeve means for removable attachment to, and detachment from the body.

In preferred embodiments, the tubular body is hollow, and has an opening at the end opposite the blunt tip. The inner wall surfaces of the body can carry means for holding or supporting devices placed inside the body. These holding or supporting means can, for example, be a plurality of radially, inwardly projecting fins mounted on the inner surface of the wall with the inner edges of the projections describing a tubular space for holding devices such as batteries, fluid-projecting devices, sound-emitting devices and powerpacks therefor, flashlights or strobe lights, or some combination of two or more of these devices.

The rigid projection joined at substantially right angles to the longitudinal axis of the body is, in preferred embodiments, hollow along its entire length, and includes, at one end, a blunt, sharp or rounded portion. As with the tip, the end portion can have an uneven or serrated surface to cause formation of a telltale mark on an assailant. Preferably, the rigid projection and tubular body are formed together, as in an injection-molding process. However, the rigid projection may include a portion at its other end adapted for joining the projection to an opening in the wall of the body. The joining can be effected by cementing or ultrasonic bonding of the end portion on the projection into an opening in the wall of the body. The projection preferably includes curved flange means that are contiguous with the wall of the body when the projection is joined to the body, thus forming suitable means for accommodating comfortably the inner surfaces of the index and third fingers of a human hand.

The device is intended to be held in either hand. Where the device has a single projection near one end of the body, the device is intended to be held with the projection held between the index and third fingers of a human hand. Where the device carries more than one projection, one of the projections may, when properly held, fall between the user's middle and ring fingers. When so held, the device can be used for self-defense from attack by directing a blow at an attacker with the projection, with the blunt tip of the body, or with the other end of the body. Such a blow can be a straight thrust, a downward thrust, an upward thrust, a backward thrust, or a crossarm or sweeping thrust.

In preferred embodiments, the device includes a closure means for the body attached to or attachable to the tubular body at the end opposite the blunt tip. Preferably, this closure means has a lower portion with attachment means at its periphery, such as external threads. For this embodiment, the body has complementary attachment means, such as complementary threads, on the internal wall surfaces of the body adjacent to the opening at the end of the body opposite the blunt tip. In this embodiment, the closure also includes an upper portion with flange means, such as a circumferential flange, thereon. The body portion, in this embodiment, includes, on its outer wall surfaces, flange means adjacent to the opening that are complementary to the flange means on the upper portion of the closure.

The closure itself can include a peripheral portion or a central portion that is transparent to light, or can be wholly opaque. Moreover, the closure can have a flat profile, a tiered profile, with or without a recess beneath the tiered area, and can be one piece, or can be split into two, three or more portions. The three-portion closure can have two side portions joined to the opening atop the body, with a central portion spring-loaded and spring-biased into a closed position, but readily openable by engagement of the flange means at the periphery of the closure with a thumb or other finger of a human hand.

The invention can better be understood by reference to the drawins in which.

Figure 1:
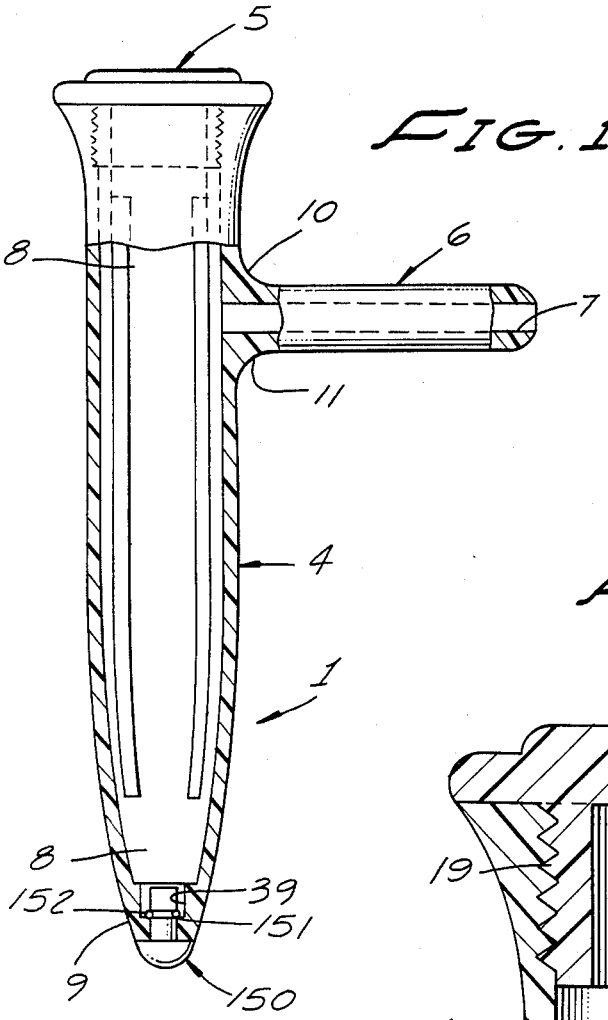
FIG. 1 illustrates the preferred embodiment of the basic self-defense/attack device of this invention.

FIG. 1 illustrates the preferred embodiment of the attack/self-defense device 1 of this invention. The device includes hollow, tubular, rigid body 4, preferably made of thermoplastic resins such as polycarbonate, nylon, acetal or thermosetting resins such as glass-filled polyester, epoxy, phenolic, melamine, and urea formaldehyde, or hard woods, metal or ultra-strong glass, such as Pyroceram, or a ceramic. Joined to body 4 at substantially right angles is rigid, hollow projection 6 having circumferential flange 10, 11 that is contiguous to the outer wall surface of body 8 where projection 6 joins to body 8. Projection 6 and body 4 can be molded together as one piece. Projection 6 has a tubular opening 7 extending along its longitudinal axis from one end to the other. Opening 7 communicates directly with hollow opening 8 inside tubular body 4.

One end of tubular body 4 tapers to blunt tip 9. Where blunt tip 9 is less than about two inches in length, and where the tip is substantially blunt rather than sharp, the device is primarily for self-defense. Where tip 9 tapers to a sharper point, and is longer than approximately two inches in length, the device is primarily for attack purposes, but is also suitable for self-defense. At the end of body 4 opposite blunt tip 9 is closure 5. Closure 5 is attachable to, and detachable from, body portion 4 to permit insertion into hollow space 8, and removal therefrom of devices such as batteries, spray-ejecting means, whistles and batteries for powering whistles, flashlights and strobe lights.

Blunt tip 9 is hollow, and shaped to receive plug member 150. Plug 150 has a head portion 151 that conforms to, and forms a continuous profile with body portion 4 at tip 9. Plug 150 carries O-ring 152 that removably seats in counterbored passageway 39.

Figure 3A:
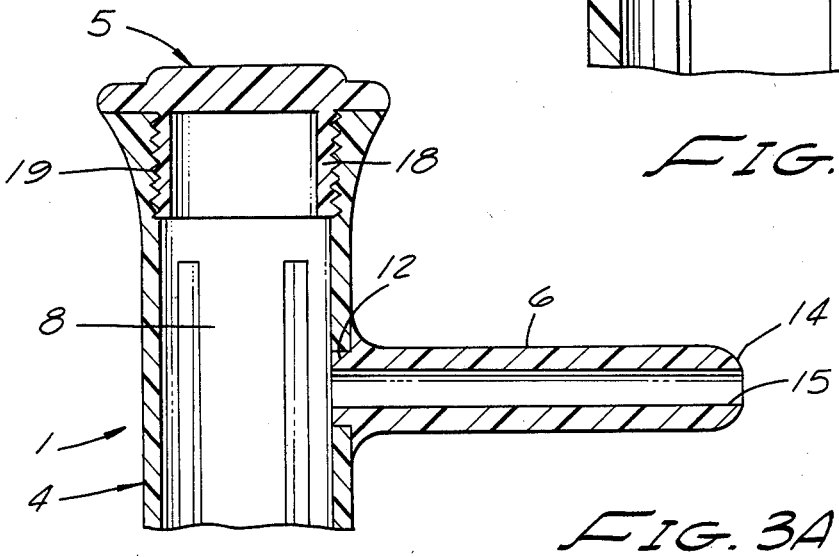
FIGS. 3A and 3B illustrate two different embodiments of the projection to be joined at substantially right angles to the body unit depicted in FIG. 1.
Figure 3B:
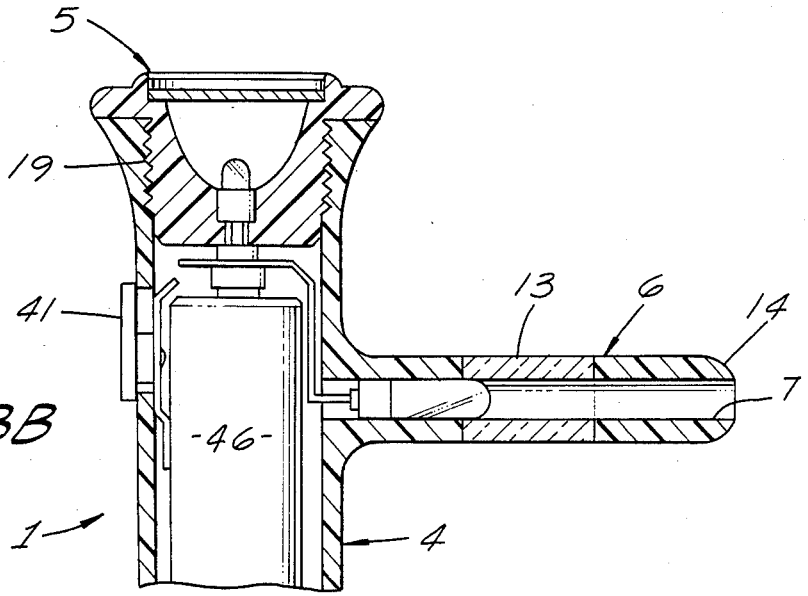

FIGS. 3A and 3B show two embodiments of portion 6. In FIG. 3A, projection 6 includes, at the left-hand end, a projection 12 having a smaller inside diameter than projection 6. End projection 12 fits in an opening of complementary size and shape in the side wall of tubular body 4. Preferably, projection 12 is of a size and shape to be inserted and held by friction, cement or ultrasonic bonding in the opening in the side wall of body 4. In FIG. 3B, body 4 and projection 12 are molded together. At the other end of projection 6 is blunt, rounded tip 14. Tip 14 includes therein opening 15 to permit ejection therethrough of fluids such as dyes or capsicum oleoresin compounds. Where the device includes a strobe flasher or flashlight flasher, projection 6 can include a light-transparent section or window 13 of substantial length and width to permit light therefrom to be directed at an assailant.

Figure 2A:
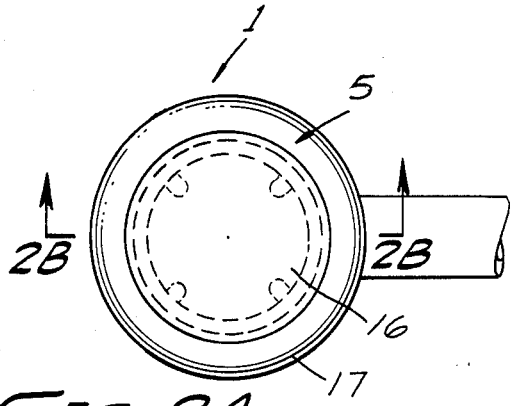
FIGS. 2A, 2B, 2C, 2D, 2E and 2F illustrate in plan and side elevation views, three different embodiments of closure means for the body.
Figure 2B:
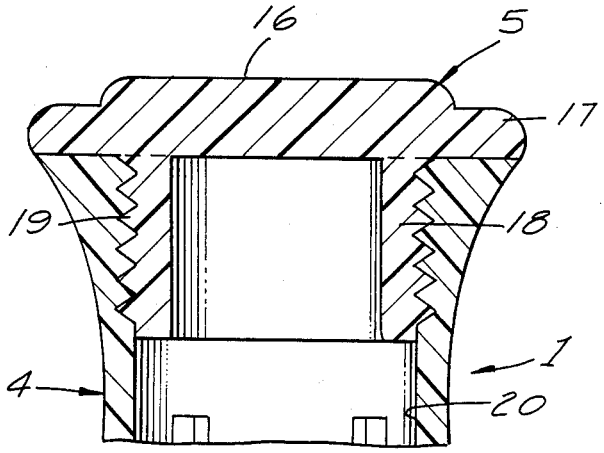

FIGS. 2A, 2B, 2C, 2D and 2E show three different embodiments of closure means 5. FIGS. 2A and 2B show a first closure embodiment with a flat-profile, upper portion 16 having circumferential flange means 17 at its periphery. This closure includes a second portion 18 of smaller circumference than portion 16. Portion 18 has external threads 19 thereon. Threads 19 are complementary to the threads on inner wall surface 20 of body 4 (see FIG. 1).

Figure 2C:
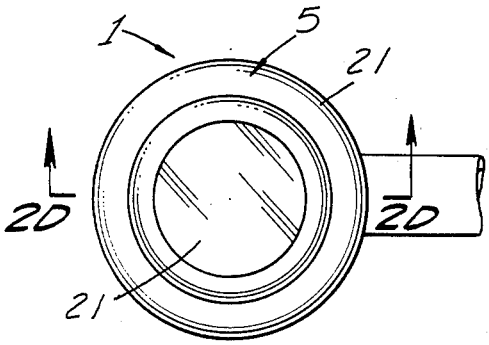
Figure 2D:
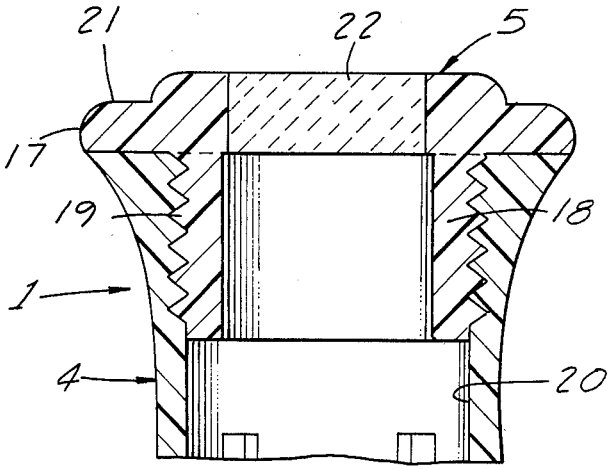

FIGS. 2C and 2D show a second closure embodiment having a flat surface with a circumferential portion 21 that is substantially transparent to light as a lens and a central portion 22 that is opaque, or vice-versa. Alternatively, closure 5 may be transparent over its entire area. In either case, light passing through the closure may be emitted from a strobe flasher, flashlight flasher or flashlight placed inside body 4.

Figure 2E:
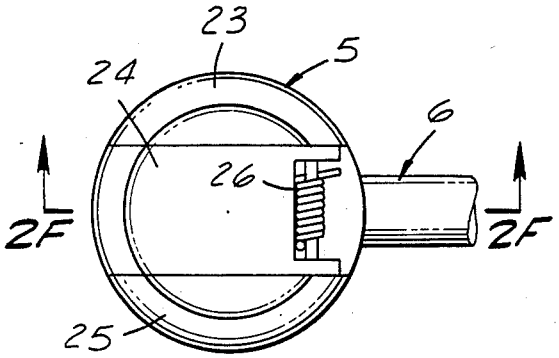
Figure 2F:
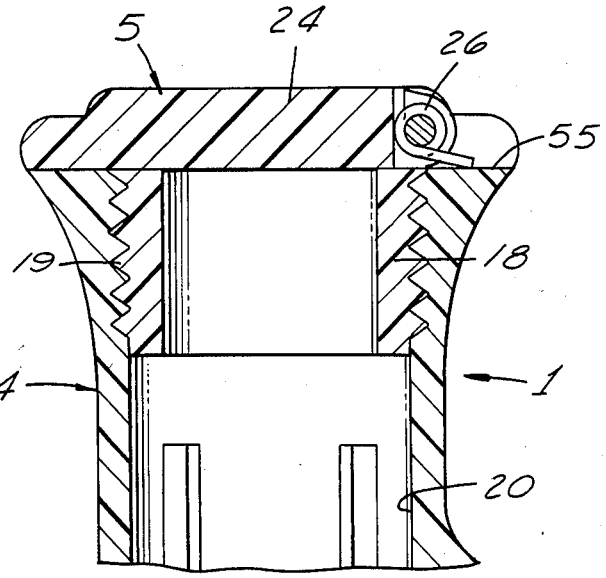

FIGS. 2E and 2F show a third closure embodiment with a flat profile split into three portions, namely edge portions 23 and 25 and central portion 24. Central portion 24 is spring-loaded and spring-biased to the closed position by spring means 26.

Figure 4A:
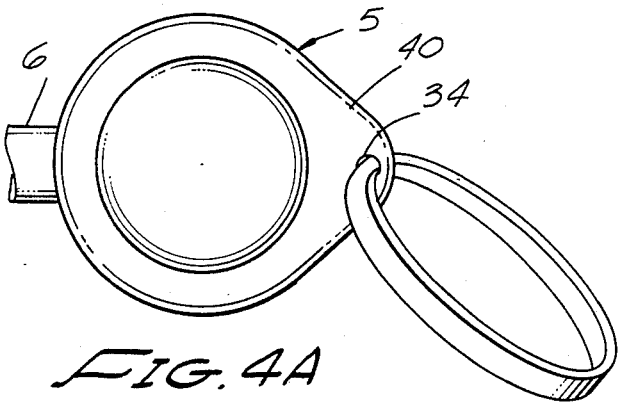
FIGS. 4A, 4B and 4C illustrate a plurality of means for holding keys that can be combined with the device depicted in FIG. 1.
Figure 4B:
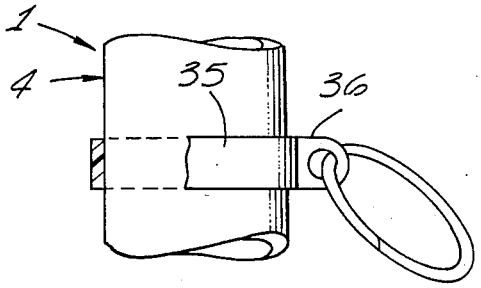
Figure 4C:
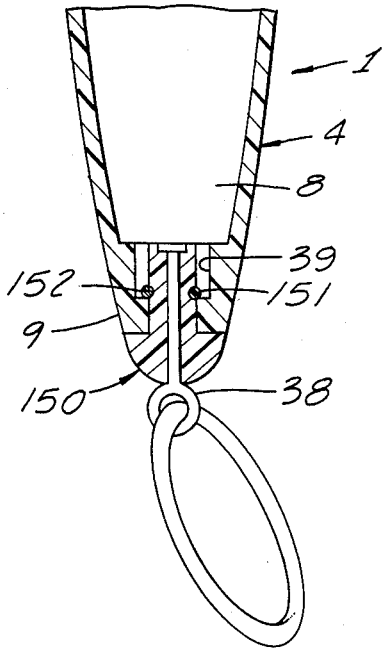

FIGS. 4A, 4B and 4C show three embodiments that include key-carrying modifications of the device depicted in FIG. 1.

FIG. 4A shows a first key-carrying modification of the device depicted in FIG. 1. Here, cap 5 includes an opening 34 in cap projection portion 40 for attachment of keys or for attachment of other means for attaching keys thereto. This modification can be combined with any of the closures in FIGS. 2A through 2F.

The device of FIG. 4A can be carried on the user's wrist where a wrist loop is joined to opening 34. This alternative embodiment provides the user with quick access to the device in case of sudden attack.

In FIG. 4B, sleeve 35 attached to the outer wall surface of tubular body 4 is joined to loop 36 for attachment of keys thereto. A wrist loop can, in the alternative, be joined to loop 36 to give the user quick access in case of a sudden attack.

In FIG. 4C, tubular body 4 includes, in an opening 39 at the end of blunt tip portion 9, an insert 37 with key-holding loop 38 joined thereto. Insert 37 is held in opening 39 by friction with O-ring 152, and can be removed, where a key attached to loop 38 is, for example, inserted in a lock, by pulling body 4 sharply to break the friction forces holding insert 37 in body 4. Such an insert can, alternatively, be made for insertion into the end of spur 6.

Figure 5:
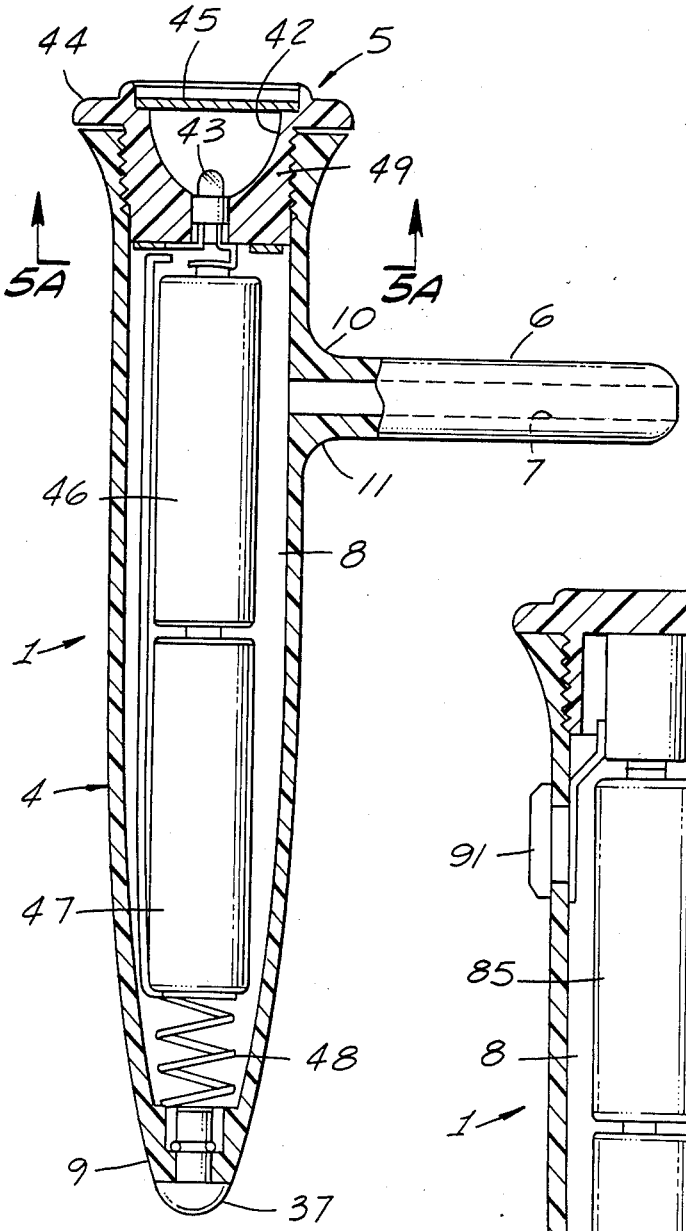
FIGS. 5 and 5A illustrate an embodiment of the device depicted in FIG. 1 that includes a flashlight flasher or a strobe flasher.
Figure 5A:
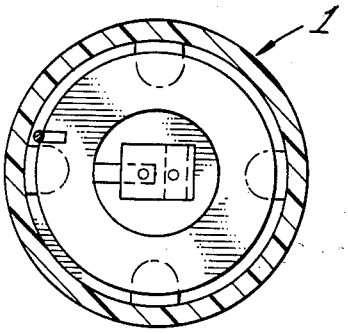

FIGS. 5 and 5A show another modification of the device depicted in FIG. 1. Tubular hollow space 8 inside tubular body 4 permits adapting body 4 for use as a flashlight, flasher or strobe light. In FIG. 5, spring 48 inside body 4 supports penlight batteries 46 and 47. Atop battery 46 is flashlight bulb fixture 49 with bulb 43 therein. Bulb 43 projects into reflecting dome 42 whose upper end abuts, or is adjacent to, closure 5. Closure 5 has a central portion 45 that is substantially transparent to light, and a peripheral portion 44 that is substantially opaque. Turning closure 5 into the internally-threaded opening atop body member 4 brings contact 160 into engagement with battery contact 161, and end portion 163 of spring-based contact 48 into engagement with base 162 of fixture 49. Turning closure 5 in the opposite direction causes disengagement, extinguishing bulb 43.

As FIG. 3B indicates, the batteries depicted in FIG. 5 can also be used to power a strobe flasher mounted in hollow space 7 in projection 6. In this embodiment, portion 13 of projection 6 is transparent to light, permitting the user to blind momentarily an attacker when button 41 is engaged, as shown in FIG. 5. Alternatively, instead of button 41, the flasher could be activated in the same way as bulb 43 in FIGS. 5 and 5A.

Figure 6:
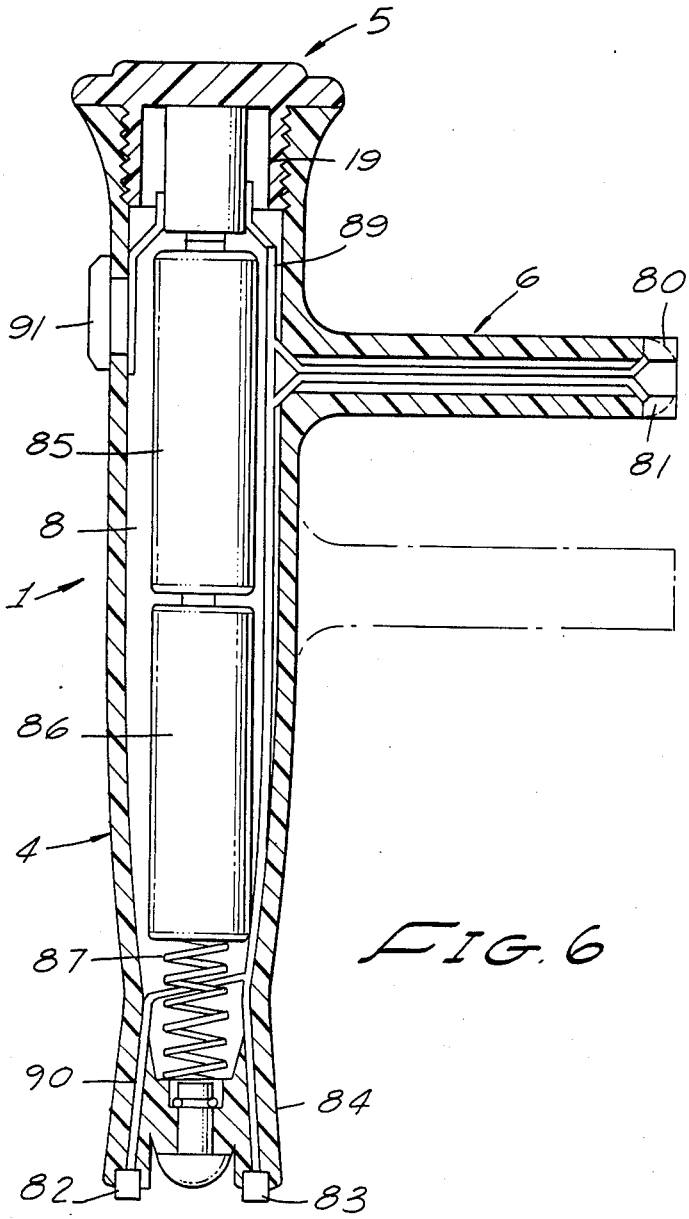
FIG. 6 illustrates a modification of the device depicted in FIG. 1 that includes means for shocking or stunning an attacker.

FIG. 6 shows a modification of the device depicted in FIG. 1 that includes means for delivering an electrical stunning shock to an assailant. In this embodiment, electrical contacts 80 and 81 project from spur 6, and can be touched to the body of an attacker to deliver a stun or shock to the attacker. Alternatively, or in addition, the device can include a second pair of electrical contacts 82 and 83 mounted in projection 84 attached to the tip of the device to form a relatively flat surface from which contacts 82 and 83 protrude. Contacts 82 and 83 are linked to the electrical capacitor means 88 via conductors 89 and 90. Batteries 85 and 86, held in place at one end by spring 87, energize capacitor means 88. Switch 91 permits a user of the device to discharge the capacitance 88 through conductor 89 and contacts 80 or 81 or through conductors 89 and 90 and electrodes 82 and 83 when desired.

Figure 7A:
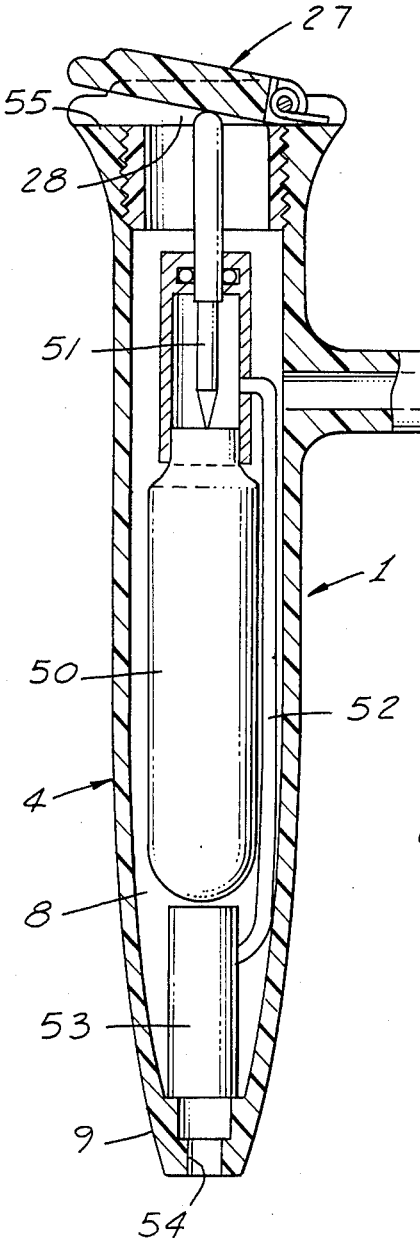
FIGS. 7A and 7B illustrate two different embodiments of the device depicted in FIG. 1 that include means for emitting piercing sounds such as a whistle.
Figure 7B:
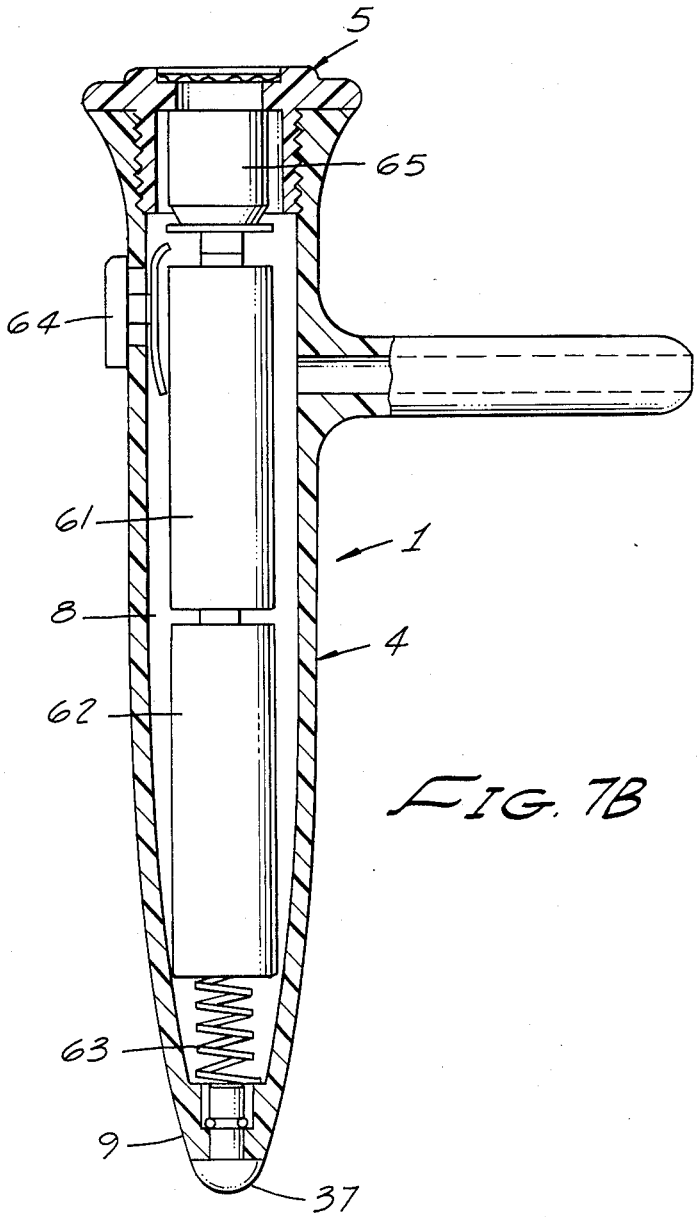

FIGS. 7A and 7B show modifications of the device depicted in FIG. 1 that include means for emitting a piercing sound to deter attackers. In FIG. 7A, a carbon dioxide cartridge or aerosol cannister 50 is inserted in hollow space 8 inside tubular body 4. Cartridge piercing pin 51 is positioned to penetrate the top of carbon dioxide-containing cartridge 50 by downward pressure on in 51, from the device-user's thumb or otherwise. Access to pin 51 is obtained by raising spring-loaded cap 27, which includes recess 28 under dome 27 for accommodating pin 51. Pin 51 projects above the plane of the opening at 55 in tubular body 4. Once pin 51 pierces the top of cartridge 50, carbon dioxide gas passes, under high or medium pressure, through line 52 to whistle 53. Whistle 53 then emits a piercing sound which exits from tubular body 4 through opening 54 at the bottom of blunt tip 9.

FIG. 7B shows another modification of the device illustrated in FIG. 1 which, like the device depicted in FIG. 7A, is designed to emit a sharp piercing sound to ward off attackers. Here, batteries 61 and 62, inserted in hollow space 8 inside tubular body 4, are supported by spring 63. Spring 63 is positioned inside space 8 below batteries 61 and 62, and just above blunt tip 9 in space 8. Above batteries 61 and 62 is battery-powered whistle 65. Engagement of button 64 activates whistle 65. Whistle 65 emits a piercing sound that is more effective when cap 5 is opened. Alternatively, cap 5 can have a central portion that is made of mesh-like material to facilitate passage of the sound therethrough.

Figure 8:
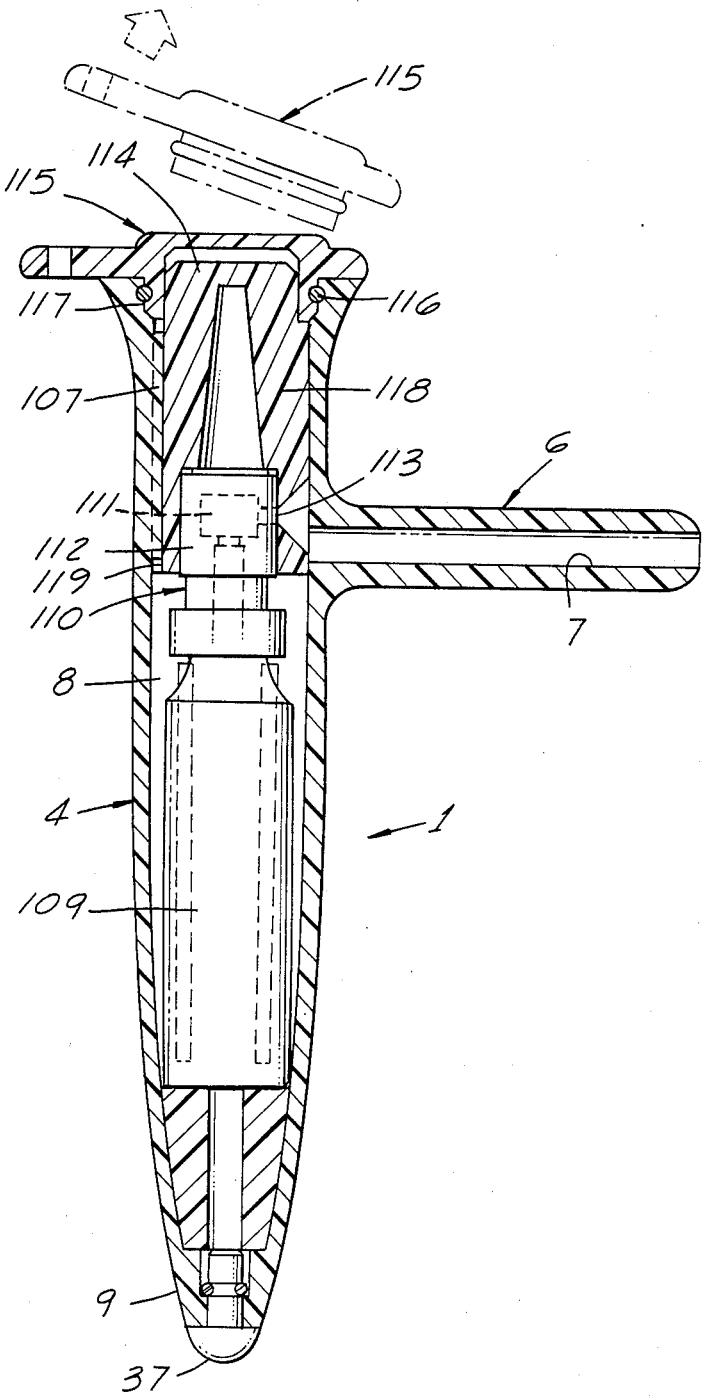
FIG. 8 illustrates a modification of the device depicted in FIG. 1 that includes means for directing self-defense sprays at an attacker.

FIG. 8 illustrates another modification of the embodiment shown in FIG. 1. Here, gas canister 109 is inserted in space 8 inside tubular body 4. Atop gas cannister 109 is valve 110 actuated by finger pressure on plunger 118. Plunger 118 is a plug whose external diameter is slightly smaller than the internal diameter of body 4. Plunger 118 has longitudinal slot 119 in its peripheral surface. Slot 119 engages projection 107 that is attached to the inner wall of body 4. Engagement of projection 107 in slot 119 assures proper orientation of plunger 118 inside body 4.

Opening 113 permits gases to pass from valve body 112 through opening 7 in spur 6 when plunger 118 is depressed, registering opening 113 with opening 7. Projection 114 assists the user in registering his fingertip atop plunger 118.

Closure member 115 is seated in opening 117 of body 4, and held there by frictional engagement of O-ring 116 with the inner surface of opening 117. Closure 115, which has the teardrop configuration of cap 5 in FIG. 4A, projects beyond opening 117, and can be forcibly ejected from opening 117 by finger pressure to expose plunger 118 for immediate use, as, for example, in case of a sudden attack.

Figure 9:
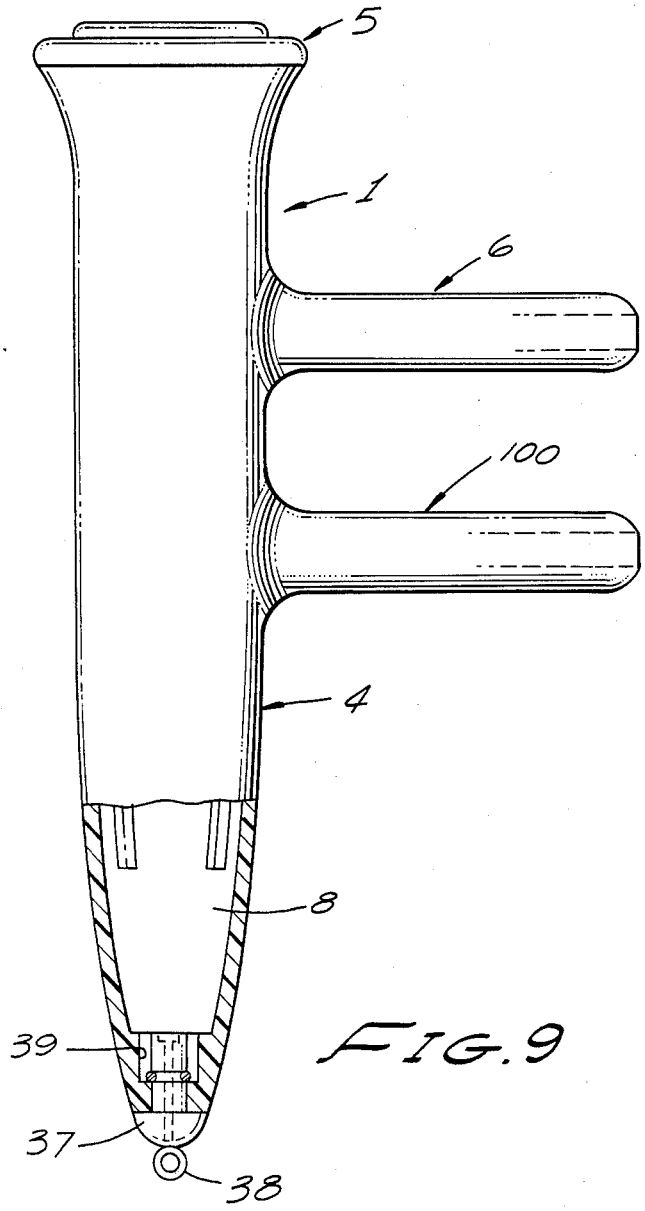
FIG. 9 illustrates an alternative embodiment of the basic self-defense/attack device of the invention.

FIG. 9 illustrates an alternative embodiment of the basic attack/self-defense device of FIG. 1. In this embodiment, body 4 carries two rigid projections 6 and 100. The user grips this embodiment in either hand with projection 6 between the first and middle fingers, and projection 100 between the middle and ring fingers.

Among the substances that can be propelled from the devices of this invention upon attack are substances such as capsicum oleoresin in an inert solvent, or capsicum oleoresin in a non-toxic solvent such as acetone, methylethyl ketone, ethylene dichloride, isopropyl alcohol and tetrachloroethylene. Alternatively, or in addition, the devices can be utilized to propel dyes such as methyl violet or fluorescent materials in anthracene solutions. These devices can also be used to propel mace, which is alpha chloroacetophenone in a carrier such as freon or another non-toxic carrier with or without a stable dye and with or without a fluorescent substance. These devices can also be used to propel substances that emit a penetrating odor such as an industrial essential oil. One useful fluorescent dye has the tradename Tinopal CBS-X, available from Keystone-Inghan Corporation of La Mirada, Calif. A dilute solution of this dye in water forms an indelible spot on the skin that emits a strong blue-white fluorescence in the presence of a UV light source. Other water-soluble, stable dyes can also be used.

What is claimed is:

1. A self-defense device comprising a rigid, tubular body haivng a blunt tip at at least one end, said body having a length not substantially greater than the width of one human hand, and being adapted for gripping in one hand, and, joined to said body at substantially right angles to the longitudinal axis of said body, and closer to the other end of said body than to sid one end, at least one rigid projection shorter in length and smaller in circumference than said body, projection having a length and circumference adapted for gripping between two fingers of a human hand, said blunt tip being adapted to deliver non-lethal bolow to the chest or other regions of a human body.

2. A self-defense device comprising a hollow, ridid tubular body tapering to a blunt tip at at least one end and having an opening at its other end, said body having a length not substantially greater than the width of one human hand, and being of a size and shape of gripping in one hand, and, joined to said body at substantially right angles to the longitudinal axis of said body, and closer to said other end of said body than to said one end, at least one rigid, hollow projection shorter in length and smaller in circumference than said body, said projection having a length and circumference adapted for gripping between two fingers of a human hand, said blunt tip being adapted to deliver non-lethal blows to the chest or other regions of a humans body.

3. An attack device comprising a rigid, tubular body having a blunt tip at at least one end, said body having a length not substantially greater than the width of one human hand, and being adapted for gripping in one hand and, joined to said body at substantailly right angles to the longitudinal axis of said body, and closer to the other end of said body than to said one end, at least one rigid projection shorter in length and smaller in circumference than said body, said projection having a length and circumference adapted for gripping between two fingers of a human hand, said blunt tip being adapted to deliver lethal blows to the chest or other regions of a human body.

4. An attack device comprising a hollow, rigid tubular body tapering to a blunt tip at at at least one end and having an opening at its other end, said body having a length not substantially greater than the width of one human hand, and beig of a size and shape for gripping in one hand, and, joined to said body at substantially right angles to the longitudinal axis of said body, and closer to said other end of said body than to said one end, at least one rigid, hollow projection shorter in length and smaller in circumference of said body, said projection having a length and circumference adapted to gripping between two fingers of a human hand, said blunt tip being adapted to deliver lethal blows to the chest or other regions of a human body.

5. The device of claim 1, wherein 2, claim 3 or claim 4 further comprising gripping means joined to the outer wall of said body.

6. The device of claim 5 wherein said gripping means comprise projections spaced around the circumference of said body, substantially in parallel to the longitudinal axis of said body.

7. The device of claim 1, claim 2, claim 3 or claim 4 further comprising means on the inner wall of said body for supporting devices placed inside said body.

8. The device of claim 7 wherein said supporting means comprises a plurality of inwardly, radially projecting members whose outer edges describe a substantially cylindrical opening for said devices.

9. The device of claim 1, or claim 2, or claim 3 or claim 4 further comprising closure means for said body at said other end, said closure means having a lower portion with attachment means at its periphery, said body having complementary attachment means on the internal wall surfaces of said body adjacent to said other end, said closure means further comprising an upper portion with flange means thereon, said body portion having on its outer wall surfaces adjacent said other end flange means complementary with the flange means on said upper portion.

10. The device of claim 1, or claim 2, or claim 3 or claim 4 wherein said projection includes, on its outer wall surface, curved flange means contiguous with said body when said projection is joined to said body, said projection including an end portion adapted to fit snugly into a complementary opening in said body, and to be retained in said opening by friction.

11. The device of claim 1 or claim 2 wherein blunt tip is less than about two inches in length and is substantially blunt.

12. The device of claim 3 or claim 4 wherein said blunt tip is longer than about two inches in length, and tapers substantially to a point.

* * * * *